US005081946A

United States Patent [19]

Nannig et al.

[11] Patent Number: 5,081,946

[45] Date of Patent: Jan. 21, 1992

[54] FLOATING DOCK

[76] Inventors: Urban R. Nannig, 515 Shore Acres Ave.; Douglas W. Nannig, 15 Circle Dr., both of North Kingstown, R.I. 02852

[21] Appl. No.: 580,481

[22] Filed: Sep. 11, 1990

[51] Int. Cl.[5] ..... B63B 35/44

[52] U.S. Cl. ..... 114/264; 114/266; 114/267

[58] Field of Search ..... 405/219; 114/264, 266, 114/267

[56] References Cited

U.S. PATENT DOCUMENTS 3,157,144 11/1964 De Jarnett ..... 114/267
3,858,877 1/1975 Lundstrom ..... 114/267 X
4,353,320 10/1982 Sluys ..... 114/267
4,365,577 12/1982 Heinrich ..... 114/267
4,453,488 6/1984 Watchorn ..... 114/266
4,602,587 7/1986 Lyons ..... 114/267 X

*Primary Examiner*—Sherman Basinger
*Attorney, Agent, or Firm*—Barlow & Barlow, Ltd.

[57] ABSTRACT

A floating dock section is attachable to adjacent sections to provide floating dock structures of various configurations. The sections are formed by coating polymer foam with a polyurethane elastomer so as to seal the polymer foam. A decking is affixed to the coated foam with an adhesive which may be a polyurethane elastomer and extending downwardly from the decking are edge members that tightly grip the polymer foam. The entire structure is coated when assembled by applying a polyurethane elastomer of somewhat denser material and the decking itself may be suitably roughened to avoid slippage.

3 Claims, 1 Drawing Sheet

FLOATING DOCK

BACKGROUND OF THE INVENTION

There have been provided in the past a number of floating dock structures and the principal floatation medium has been a polystyrene foam block. The foam, however, has a tendency to break off in chunks. This is not environmentally acceptable. In addition, the pontoons, as they are sometimes known, do not readily withstand the natural abuse of the environment and are easily fouled with marine growth. Typical floating docks are seen, for example, in Dunlop, U.S. Pat. No. 4,223,629, that discloses a rectangular frame supporting a wood plank decking maintained afloat by blocks of floatation material. These exists, however, a need for a floatable load-supporting dock structure which can be put together in uniform sections and disassembled rapidly for winter storage and the like and which are relatively light so that they may be transported with minimal cost and inconvenience.

SUMMARY OF THE INVENTION

The invention is basically directed to a floating dock structure which consists of a primary floatation member that is composed of a polymer foam block such as is known under the tradename Styrofoam. Each floatation member is entirely encapsulated in a shell or skin which is preferably a polyurethane elastomer and extending completely over and around the periphery of each floatation member is a space that is created for the running of utility lines and the like. Over the floatation member and extending in abutting relationship to the side wall thereof is first a deck assembly which includes edge members that extend downwardly therefrom to embrace the floatation member. The deck has access ports cut therein at the corners thereof to communicate with the peripheral space in the upper edges of the floatation member. At the corner of the edge members, a number of eye bolts are affixed which serve to join adjacent units together to form a larger assemblage of dock members and the entire structure is coated with a second coating of a polyurethane elastomer. The deck is preferably given a non-slip surface. So that boats may tie along side without rubbing against the outer portion of the structure, fenders are provided on the outer side of the edge members.

DESCRIPTION OF THE PREFERRED EMBODIMENT

Figure 1:
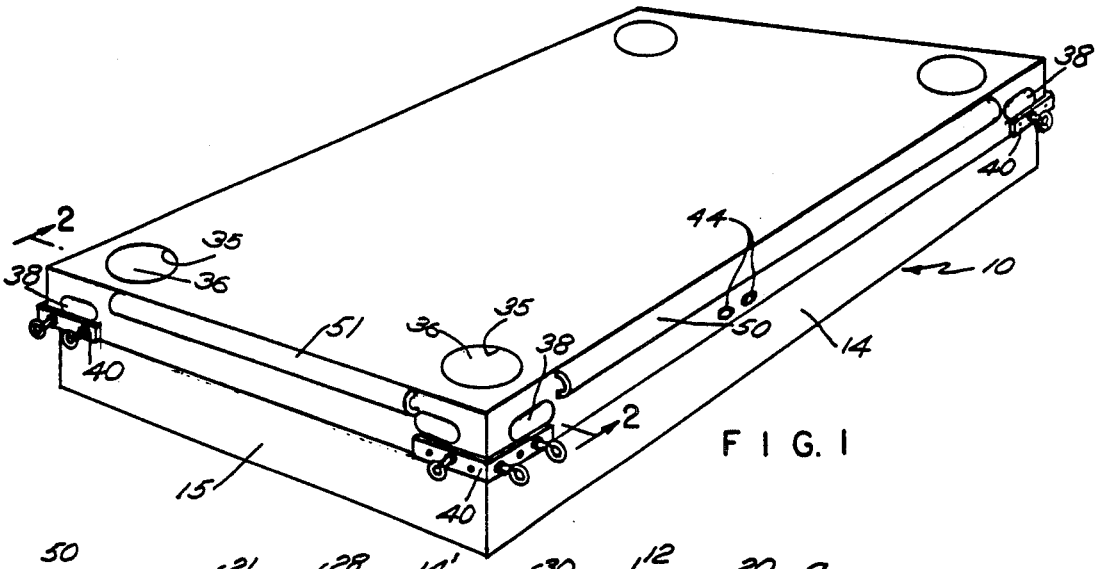
FIG. 1 is a perspective view of a floating dock structure in accordance with the invention.
Figure 2:
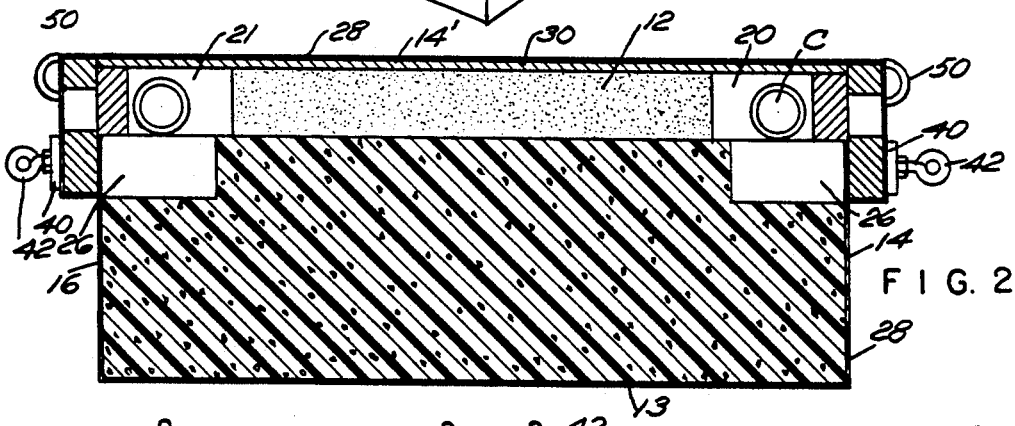
FIG. 2 is a sectional view taken on line 2—2 of FIG. 1.

The floating dock structure essentially consists of a floatation member generally designated 10 which has a top wall 12, a bottom wall 13 and four side walls 14, 15, 16 and 17. The floatation member is preferably made from a polymer foam such as Styrofoam and is provided with rabbets, such as edge channels 20 and 21 which extend around the periphery of the floatation member and which provide room for placing utility conduits such as the conduit C. The grooves are of a sufficient size so that more than one utility can be accommodated. At the corners joining adjacent grooves is a further recess 26 (see FIG. 4), which recess is of triangular shape in plan and of a depth sufficient to allow maintenance personnel to reach down through access holes and secure attaching bolts.

The floatation member 10, once formed with the grooves and recesses as described, is then completely encapsulated in a skin 28 which is preferably a plastic material that is impervious to water. For example, it has been found desirable to utilize a polyurethane elastomer in a two-part system which exhibits a hardness of 60–80 on the Shore A Scale and a tensile strength of approximately 1500 psi. The skin is applied to each floatation member and a final coat is applied to the top wall 12 and the entire floatation member is then forced into a deck assembly.

The deck assembly consists of a plate or decking 30 which has extending therefrom cleats 32 and side wall members 34 which may conveniently be 2"×6" or 2"×8" wooden members which may have cutouts such as 38 at the corners thereof to provide grasping holes to pick up the units and to provide a passageway for utility lines and the like to pass between joined units. Additionally the deck is provided with access ports 35 having cover plates 36 to allow access to the edge space at the top edge of the floatation member for utility lines and for joining eye bolts described below.

Figure 3:
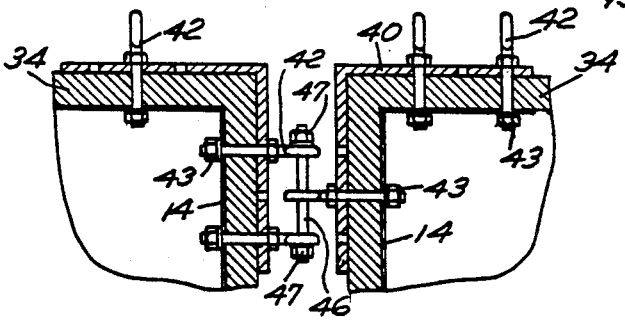
FIG. 3 is a fragmentary sectional view of the corners of two dock structures showing the means of attaching adjacent structures.
Figure 4:
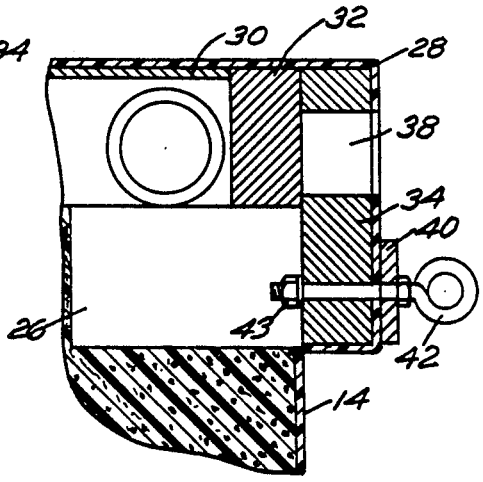
FIG. 4 is a fragmentary enlarged view showing the detail of construction of the dock structure at the corners thereof.

It will be noted particularly by reference to the drawings that corner pieces 40 are provided which are formed of a non-corrosive metallic composition and passing through the corner pieces 40 are a plurality of eye bolts or elements with an aperture such as 42 which are secured on the inner wall of the members 34 by nuts 43, for example (see FIG. 4). The corner pieces are drilled to accept three eye bolts but it will be appreciated that in order to join adjacent sections, as seen in FIG. 3, that two eye bolts will be placed on one dock module while on the adjacent a single one, there will be one so that a common bolt 46 with nuts 47 may pass therethrough to join the members together. Along the longest side wall 34, anchored nuts 43 will be embedded at a distance from the corners to accept threaded eye bolts and when the eye bolts are installed, a L formed dock may be constructed with the short side joined to the longer side.

It should be appreciated that the dock structure may be provided in a variety of sizes and shapes but it has been found very desirable to form the top deck 30 with a 4'×8' standard piece of ½" plywood which avoids any unnecessary cutting and the like. The foam material that has been found quite suitable has had a 1–2 pound density and has a thickness of between 12" and 24" and is cut suitably to fit within the deck framework described above. In practice it has been found that a thickness of 16" is suitable.

The arrangement is such that to assemble the units, the deck and side walls are constructed and applied with certainly a first coating of suitable polyurethane elastomer. The foam blocks are then suitably cut, coated with an elastomer and as indicated, the top wall is coated with a second coating 14' and then the deck assembly and the foam are pressed together and the layer 14' will adhesively secure the foam to the deck maintaining the entire structure together without the utilization of any fasteners. The entire unit is then coated again with a polyurethane coating and after suitably finished with the hardware, fenders such as 50, 51 are affixed. When desired and before final assembly, if conduits are necessary then conduits are placed in the longitudinal groove such as 20 and 21 before the parts are assembled as described above.

It will be seen that essentially, the floating dock structure becomes a two-part system consisting of the deck assembly and the floatation member that become integral. The decking is sufficiently strong as it is in contact with the floatation foam so that it requires no further support since the foam is completely encapsulated there is not environment damage that can take place due to the fact that it is sprayed with at least 100 ml. of polyurethane elastomer. The top surface, such as the deck, can also be surface coated with a ultraviolet resistant polyurethane color coat such as an aliphatic polyurethane which would be placed over the aromatic polyurethane elastomer.

I claim:

1. A floating dock, comprising (a) a floatation member constituting a monolithic element formed of a foamed polymer, the member having a generally rectangular plan, having vertical sides, corners at the junction of adjacent sides and having a flat top surface, the member being formed with a rabbet having a vertical surface that terminates at the said top surface and a horizontal surface that terminates at the said vertical sides, recesses formed in the floatation member extending downwardly from the horizontal surface of the rabbet at the corners; and (b) a dock assembly including a deck plate that rests on the said top surface of the floatation member and includes side wall members that extend downwardly from the deck plate and embrace the vertical sides of the floatation member, the side wall members being spaced from the vertical surface of the rabbet to define a utility service space each of said recesses in the floatation member defining a space with the side wall members, the side wall members being provided with ports giving access to the rabbet and the said spaces.

2. A floating dock as recited in claim 1 wherein the side wall members are provided with embedded fasteners to accept cooperating members and allow interconnection of dock structures.

3. A floating dock as recited in claim 1, wherein the side wall members are provided with fasteners allowing the dock to be connected to a similar dock, each fastener including an element with an aperture extending outwardly from the side wall members.

* * * * *